US006967624B1

(12) United States Patent
Hsu et al.

(10) Patent No.: US 6,967,624 B1
(45) Date of Patent: Nov. 22, 2005

(54) WIDEBAND ANTENNA ELEMENT AND ARRAY THEREOF

(75) Inventors: Chih-Chien Hsu, Cherry Hill, NJ (US); Mirwais Zeweri, Mount Laurel, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/830,797

(22) Filed: Apr. 23, 2004

(51) Int. Cl.[7] ..... H01Q 13/10
(52) U.S. Cl. ..... 343/770; 343/767
(58) Field of Search ..... 343/767, 768, 343/770

(56) References Cited

U.S. PATENT DOCUMENTS 4,782,346 A 11/1988 Sharma ..... 343/795
6,043,785 A * 3/2000 Marino ..... 343/767
6,219,000 B1 * 4/2001 McWhirter et al. ..... 343/767
6,839,036 B1 * 1/2005 Apostolos et al. ..... 343/770
6,842,154 B1 * 1/2005 Apostolos ..... 343/767
6,882,322 B1 * 4/2005 Apostolos et al. ..... 343/767
2005/0012672 A1 * 1/2005 Fisher ..... 343/767

* cited by examiner

*Primary Examiner*—Hoang V. Nguyen
(74) *Attorney, Agent, or Firm*—Duane Morris LLP

(57) ABSTRACT

A wideband antenna element includes first and second spaced-apart, mutually parallel conductive plates. Each plate defines a through aperture and a tapered slot extending from the aperture to an edge of the plate. The apertures and the slots of the two plates are registered. A feed structure including a strip conductor extends in the region between the plates, and crosses the slot at a location remote from both the edges of the plates and the apertures. A stub terminates the strip conductor. Through vias or conductors extend from one plate to the other near the edges of the slots, and near the feed. One embodiment includes dielectric sheets lying between the conductive plates.

15 Claims, 8 Drawing Sheets

WIDEBAND ANTENNA ELEMENT AND ARRAY THEREOF

GOVERNMENTAL INTEREST

This invention was made with government support under Contract/Grant SOMA N00014-02-C-0479. The United States Government has a non-exclusive, non-transferable, paid-up license in this invention.

FIELD OF THE INVENTION

This invention relates to antennas for electromagnetic transduction, and more particularly to broadband generally planar antennas.

BACKGROUND OF THE INVENTION

The antenna for electromagnetic transduction (transmitting and or receiving) is often a critical part of sensing and communication systems. In the past, simple antennas could often meet the relatively narrowband requirements of radio communications. The increased bandwidth requirements of television placed a premium on bandwidth, both to provide cost-effective solutions for the need to cover VHF bands such as 54 to 88 megahertz (MHZ), corresponding to television channels 2 through 6 and 174 to 216 MHz (channels 7 through 13). Six-megahertz Channels within these bands were often received by simple dipole antennas, with tuning to improve the response.

The introduction of color television introduced the need for phase control over each television channel in order to avoid color distortion. Various new types of broadband antennas were introduced, such as the log-periodic monopole and the equiangular spiral antenna, which, at least in theory, could have infinite bandwidths. Physical limitations, such as the need for extremely precise fabrication of the small, high-frequency responsive portions, prevented the practical bandwidths of such antennas from exceeding about 10:1. Such antennas were, and continue to be, used for various forms of surveillance and monitoring.

Many applications for which antennas are used require scanning of the antenna beam more rapidly than physical movement of the antenna allows, and may require relatively high directivity. Those skilled in the antenna arts know that array antennas are useful for such applications. A wide variety of array antennas is known. Basically, an array antenna is a one or two-dimensional arrangement of a plurality of antenna elements. Sometimes two-dimensional arrays may be nonplanar, in which case the array has three-dimensional aspects. Each antenna element (or sometimes subgroups of antenna elements) of an array is "fed" with a common signal, which may be individually phase-shifted or adjusted in amplitude to accomplish beam scanning, as known in the art.

The antenna is basically a transducer which transduces electromagnetic signals between guided waves (signals flowing in a transmission line) and unguided waves (radiated signals). For this reason, the operation of an antenna in a transmission mode of operation is basically the same as its operation in a receiving mode, and has the same characteristics. Some of the terms used in the antenna arts originated at a time when the mechanisms by which antennas operate were not well understood. For example, the antenna "feed" point or terminals was defined at a time when the transmitting function was of prime importance, and is the terminal(s) at which a signal to be transmitted (transduced to an unguided wave) is applied. Only later was it fully understood that the feed point of a "transmitting" antenna is functionally identical to the received signal port of the same antenna when receiving signals. Thus, one general term for an antenna usable for either transmission or reception is "radiator" or "radiating element." The "beam" of an antenna is a general term representing the radiated field and its characteristics. It is now understood that a given antenna has identical transmitting and receiving beams. A description of the operation of an antenna may be couched in terms of either transmission or reception, with the other mode of operation being understood as inherent therein.

The arraying of antenna elements to form array antennas introduced a host of new problems into the field. Among these problems is the interaction or mutual coupling among the elemental antennas, which can affect the apparent performance of the elemental antenna, and the need for a "beamformer" to combine the signals received by the individual antenna elements (reception mode) or divide the signal to be transmitted among the elemental antennas (transmission mode). The mutual coupling and the need for a beamformer having its own impedance characteristics makes for an intractable problem.

U.S. Pat. No. 4,782,346, issued Nov. 1, 1988 in the name of Sharma describes a horn-like finline antenna suitable for broadband operation in an array environment. The finline antenna described therein includes a dielectric plate with electrically conductive elements of the finline antenna printed or applied to each side of the dielectric. The dielectric plate(s) are fed by a rectangular waveguide.

Improved or alternative antennas are desired.

SUMMARY OF THE INVENTION

A radiating element according to an aspect of the invention comprises an electrically conductive first plate defining a through aperture and also defining a slot extending from the aperture to an edge of the plate. The slot has a transverse dimension(s) in the plane of the first plate. The transverse dimension increases monotonically with increasing distance between the aperture and the edge of the first plate. The radiating element also comprises an electrically conductive second plate defining a second through aperture identical to the through aperture of the first plate. The second plate also defines a second slot extending from the second through aperture to an edge of the second plate. The second slot has transverse dimensions in the plane of the second plate which are identical to those of the transverse dimension of the slot of the first plate. The first and second plates are spaced apart, with the through aperture and the slot of the second plate registered with the through aperture and the slot of the first plate. A feed element including a strip conductive element (lies midway between the plane of the first plate and the plane of the second plate. The feed element extends across the slots at a location removed from, or between, the through apertures and the edges of the first and second plates.

In a particularly advantageous embodiment of the radiator of the invention, the region between the first and second plates includes solid dielectric material. The shape or dimensions of the slots may be exponentially increasing with increasing distance from the apertures. In one embodiment, the slot transverse dimensions are piecewise-linear or a plurality of straight-line segments.

In one advantageous version of this aspect of the invention, the radiating element comprises a set or plurality of electrically conductive elements extending between, and connecting to, the first and second plates at least at locations adjacent the slots. In one version, a set or plurality of electrically conductive elements extends between the first and second plates at locations adjacent the feed element.

A radiating element according to another aspect of the invention comprises first and second dielectric sheets, each defining a first broad surface and a second broad surface. The radiating element also includes an electrically conductive first plate defining a through aperture, and also defining a slot extending from the aperture to an edge of the plate. The slot has a transverse dimension in the plane of the first plate which increases monotonically with increasing distance from the aperture. The electrically conductive first plate is affixed to the first broad surface of the first dielectric sheet. The radiator also includes an electrically conductive second plate defining a second through aperture identical to the through aperture of the first plate, and also defining a second slot extending from the second through aperture to an edge of the second plate. The second slot has transverse dimensions in the plane of the second plate which are identical to those of the slot of the first plate. The second plate is affixed to the first broad side of the second dielectric sheet. The second sides of the first and second dielectric sheets are juxtaposed at a juncture, with the first and second plates being spaced apart by the first and second dielectric sheets, and with the through aperture and the slot of the second plate registered with the through aperture and the slot of the first plate. A feed element including a strip conductive element lies in the juncture, with the feed element extending across the slots at a location removed from the through apertures and from the edges of the first and second plates. In a particular embodiment of this aspect of the invention, the radiating element further comprises a plurality of electrical conductors extending between, and making electrical connection with, the first and second plates, at locations lying adjacent the slots in the first and second plates.

An antenna array according to another aspect of the invention comprises a plurality of elemental radiating elements. Each of the radiating elements includes (a) An electrically conductive first plate defining a through aperture, and also defining a slot extending from the aperture to an edge of the plate. The slot has a transverse dimension(s) in the plane of the first plate, which dimension(s) increases monotonically with increasing distance from the aperture.

(b) An electrically conductive second plate defining a second through aperture identical to the through aperture of the first plate, and also defining a second slot extending from the second through aperture to an edge of the second plate. The second slot has transverse dimensions in the plane of the second plate which are identical to those of the transverse dimensions of the slot of the first plate. The first and second plates are spaced apart, with the through aperture and the slot of the second plate registered with the through aperture and the slot of the first plate.

(c) A feed element including a strip conductive element lying midway between the plane of the first plate and the plane of the second plate. The feed element extends across the slots at a location removed from the through apertures and from the edges of the first and second plates.

The plurality of radiating elements is arrayed with the edges of the plates lying in a plane, and with the planes of the plates of at least some of the radiating elements lying in planes orthogonal to the planes of the plates of the remaining ones of the radiating elements.

DESCRIPTION OF THE INVENTION

Figures 1A, 1B:
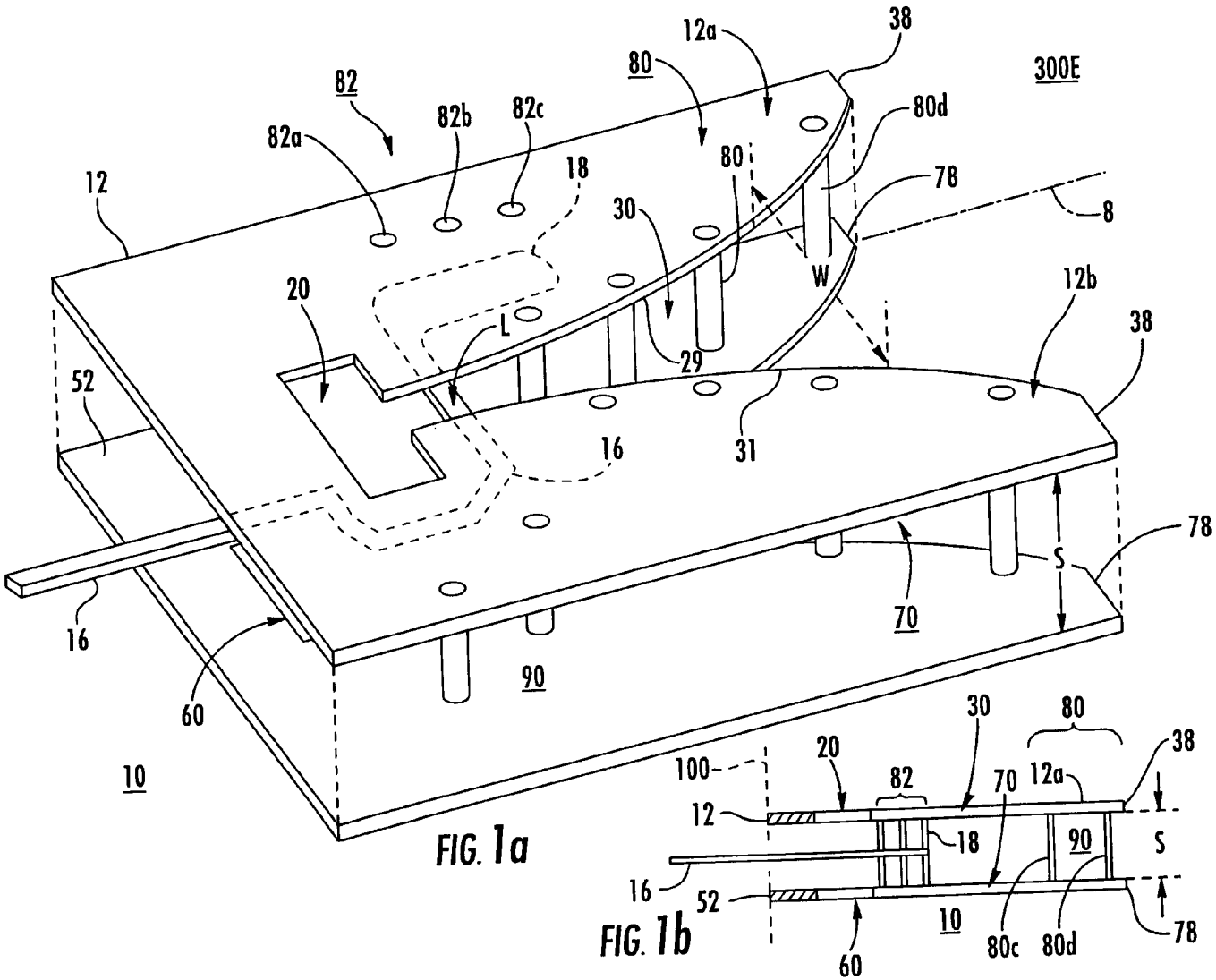
FIG. 1*a* is a simplified perspective or isometric view of a radiating element or antenna according to an aspect of the invention.
FIG. 1*b* is a cross-sectional side elevation of the antenna of FIG. 1*a*.

FIG. 1*a* is a simplified perspective or isometric view of an antenna or radiator according to an aspect of the invention. In FIG. 1*a*, a first electrically conductive plate 12 defines a generally rectangular through aperture 20 and a slot designated generally as 30 extending from the aperture 20 to an edge 38 of the plate 12. The slot 30 is defined by a first edge 29 and a second edge 31, and defines an axis 8. The transverse dimensions of the slot, designated W in FIG. 1*a*, are narrowest near or adjacent the aperture 20, and greatest at locations remote from aperture 20 and adjacent edge 38 of plate 12. The dimension W monotonically increases with increasing distance from aperture 20. As can be seen, slot 30 divides conductive plate 12 into two portions, which are designated 12*a* and 12*b*.

Also in FIG. 1*a*, an electrically conductive second plate 52 also defines a through aperture 60, and a slot designated generally as 70 extending parallel with axis 8. The dimensions of through aperture 70 in plate 52 are the same as those of through aperture 20 of plate 12, and the dimensions of slot 70 in second plate 52 correspond to those of slot 30 in first plate 12. As illustrated, first plate 12 and second plate 52 extend parallel with each other, and are separated by a distance designated as S. The aperture 20 in the first plate 12 and aperture 60 in second plate 52 are registered with each other, and the slot 30 in first plate 12 is registered with slot 70 in second plate 52. There is a gap or separation 90 between the first plate 12 and the second plate 52, as is more apparent in the cross-sectional side elevation view of FIG. 1*b*.

Figure 1C:
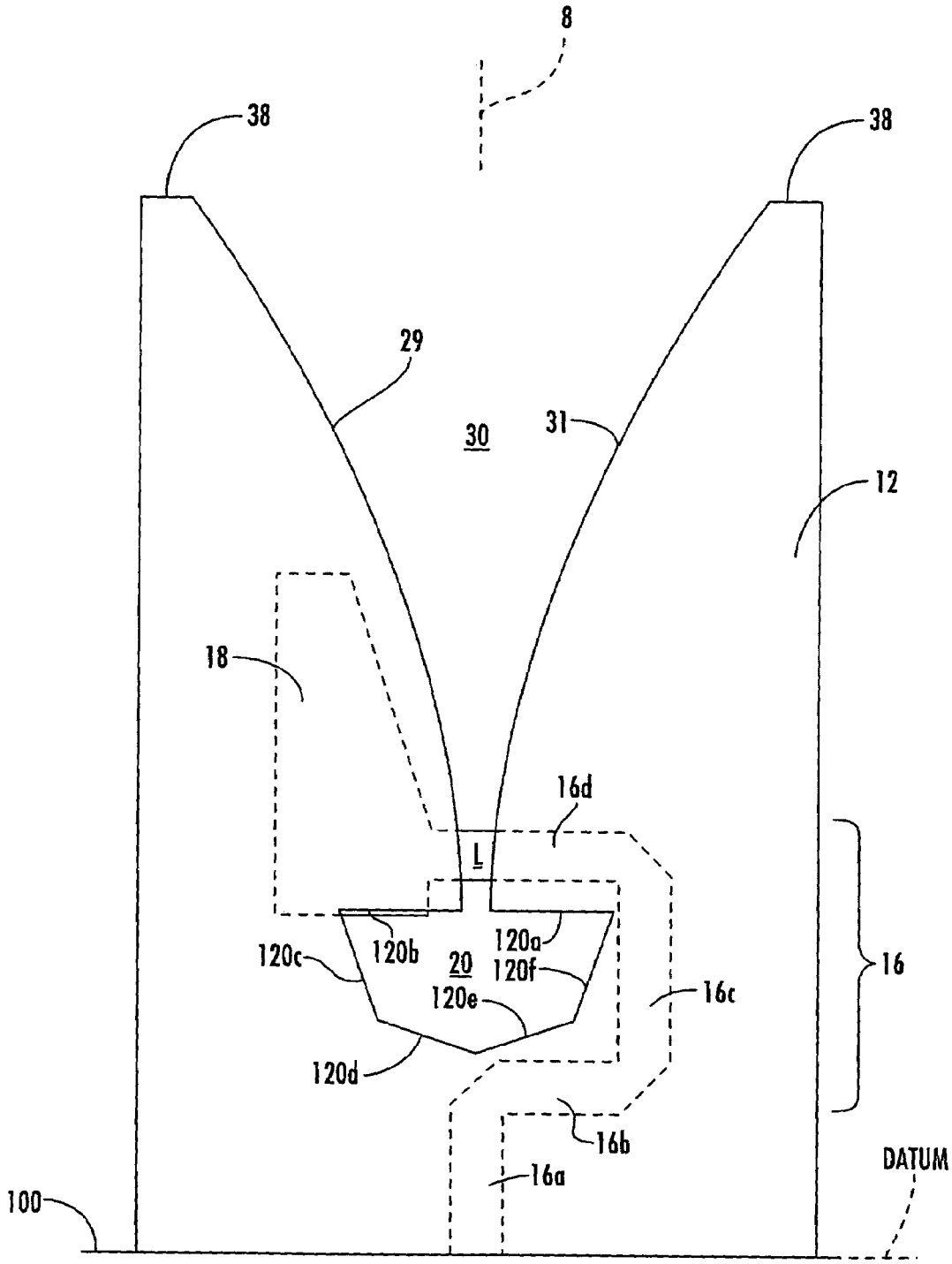
FIG. 1*c* is a simplified plan view of the structure of FIG. 1*a;*

A feed structure including a strip conductor 16 and a capacitive end element 18 lie between plates 12 and 52 of FIGS. 1*a* and 1*b*. FIG. 1*c* is a plan view illustrating conductive plate 12 with its through aperture 20 and slot edges 29 and 31 defining a slot 30. FIG. 1*c* also illustrates the feed structure 16, 18 in somewhat more detail than in FIGS. 1*a* and 1*b*.

In FIG. 1*c*, a datum or reference plane 100 is orthogonal to axis 8. As illustrated in FIG. 1*c*, the feed structure 16 includes a first strip conductor portion 16*a* projecting from datum or reference plane 100 parallel with the axis 8 of slot 30. Conductor portion 16*a* merges at a 90° turn with a second strip conductor portion 16*b*, which carries the feed electromagnetic signal in a direction orthogonal to axis 8. Another 90° turn couples the signals to a strip conductor portion 16*c*, which again carries signals in a direction parallel with axis 8, under portion 12*b* of plate 12. A final 90° turn couples the feed signals to a strip conductor portion 16*d*, which carries the feed signals in a direction parallel with, but opposite to, the direction in which they are carried by strip conductor portion 16*b*. Strip conductor portion 16*d* crosses the slot 30 at location L, thereby carrying the feed signals under portion 12*a* of conductive plate 12. Strip conductor merges with a stripline stub or capacitive termination 18, also lying under portion 12*a* of conductive plate 12. One way to view the operation of the feed structure 16, 18 is that stripline stub 18 provides significant capacitive coupling between the feed structure 16, 18 and plate portion 12*a*, while the coupling to plate portion 12*b* differs both in amplitude and phase, thereby giving rise to a voltage difference between portions 12*a* and 12*b* near location L which drives the radiation. The voltage difference may be understood as electric field lines extending from edges 29 of slot 30 to edges 31, and correspondingly in slot 70. These electric field lines may be viewed as being generated near location L, and propagating in the direction of axis 8 toward the open end 300E of slot 30 (or 70).

In FIG. 1*c*, the sides defining through aperture 20 include sides 120*a* and 120*b*, which are separated by the narrow end of slot 30. Additional sides are 120*c*, 120*d*, 120*e*, and 120*f*. The general shape of through aperture as illustrated in FIG. 1*c* is that of an irregular polygon.

Figure 2A:
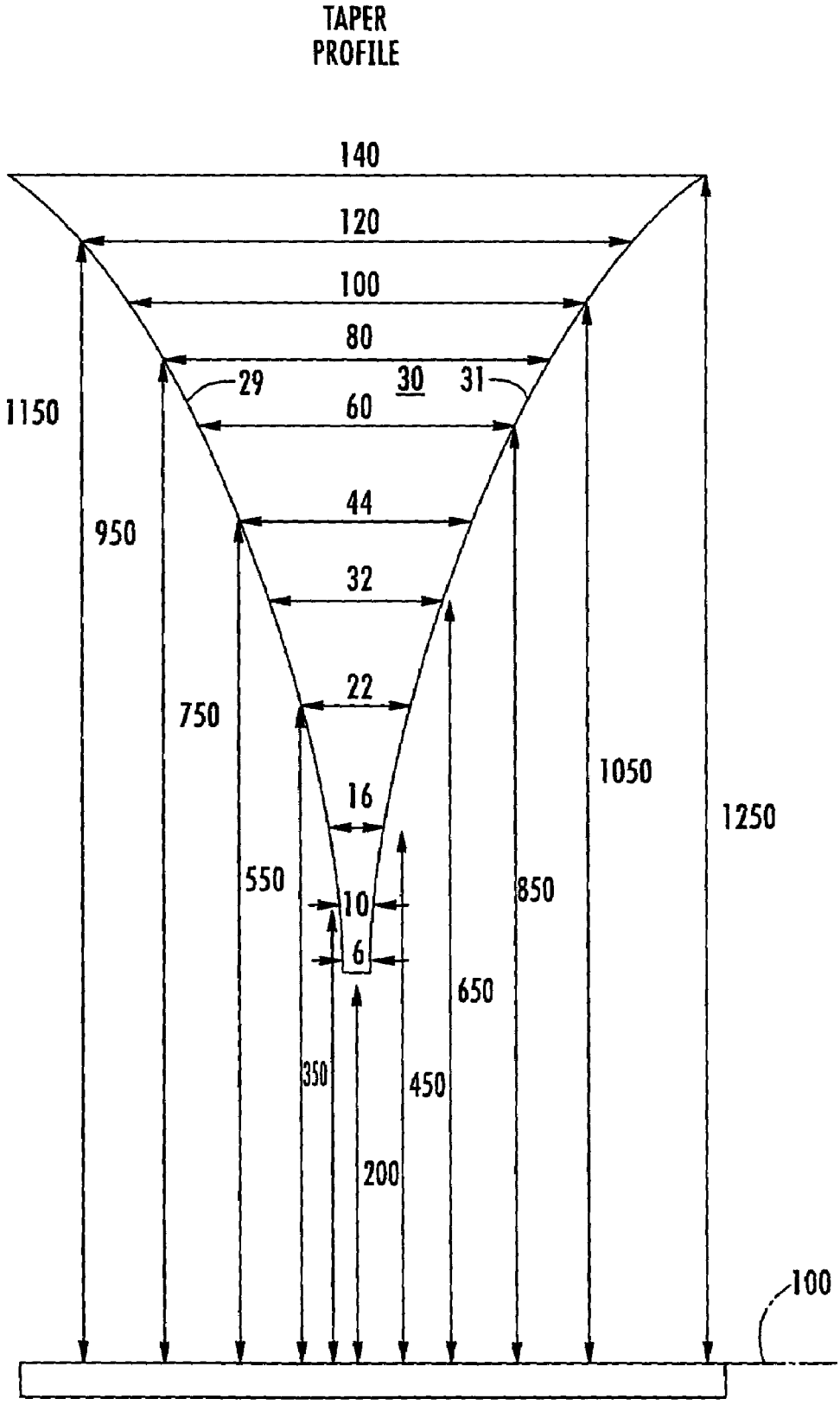
FIGS. 2*a*, 2*b*, and 2*c* are plan views of various portions of the structure of FIG. 1*c;*

FIG. 2*a* is a diagram illustrating the dimensions of the slot 30 of FIGS. 1*a* and 1*c* in one embodiment of the invention which is suitable for operation from about 2.6 to 22 GHz (although the frequency range depends upon the level of such parameters as gain and return loss). As illustrated in FIG. 2*a*, the narrowest portion of the slot 30 lies 200 mils (a mil is one one-thousandths of an inch) from reference plane or datum 100, and has a width (measured between edges 29 and 31) of 6 mils at that location. At a location 350 mils from datum 100, the width of slot 30 is 10 mils. At a distance of 450 mils from datum 100, the slot width is 16 mils. At a distance of 550 mils from datum, the slot width is 22 mils. At 650 mils from datum, the slot width is 32 mils. The slot widths at 750, 850, 950, 1050, 1150, and 1250 mils from datum 100 are 44, 60, 80, 100, 120, and 140 mils, respectively. Those skilled in the art will recognize the slot as being defined by piecewise-linear or straight-line segments.

Figure 2B:
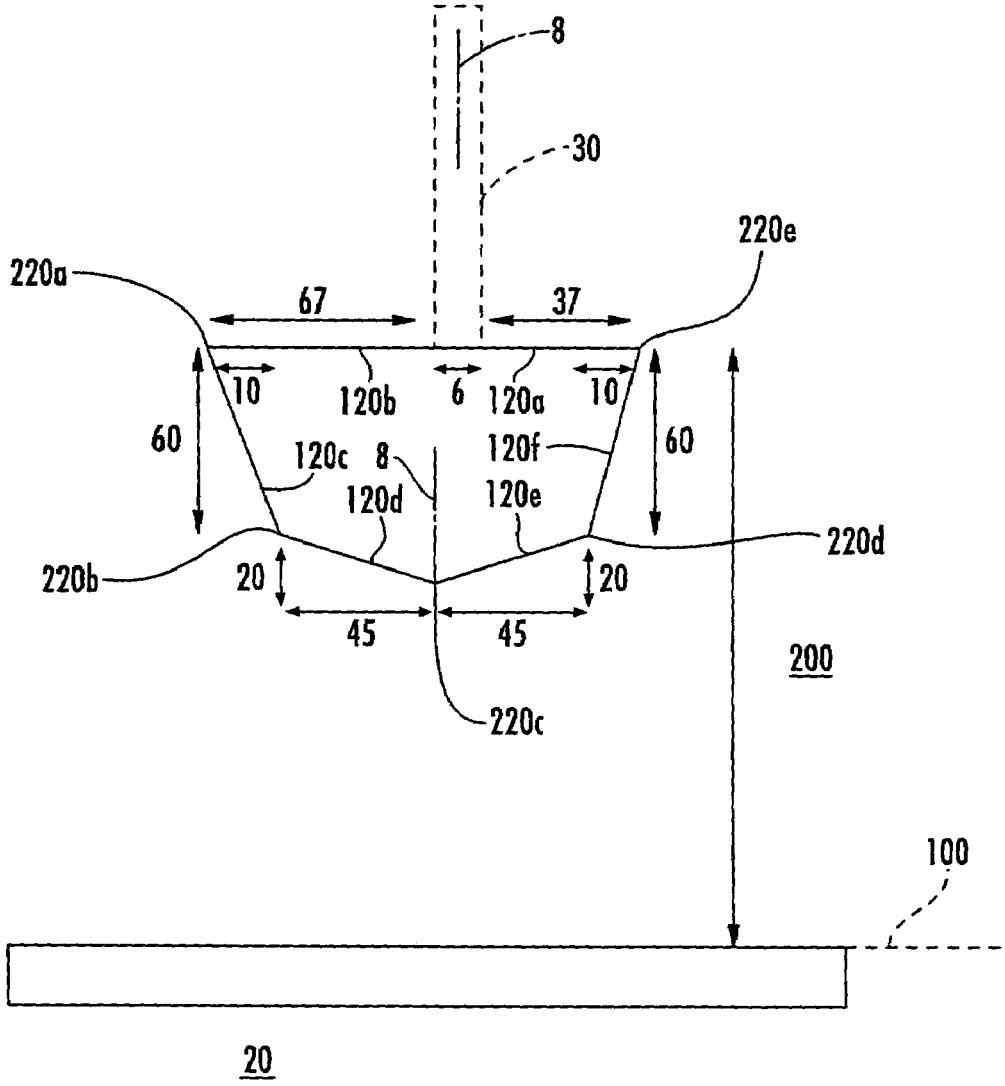

FIG. 2*b* illustrates the dimensions associated with the particular embodiment of the invention of FIG. 2*a*. In FIG. 2*b*, the sides corresponding to sides 120*a* and 120*b* of FIG. 1*c* lie at a distance of 200 mils from datum 100, and are parallel therewith. That is, sides 120*a* and 120*b* of aperture 20 are orthogonal to axis 8. Side 120*a* of aperture 20 has a length of 37 mils from slot 30 to a corner designated 220*e*, which lies to the right of axis 8 as illustrated in FIG. 2*b*. Side 120*b* has a length of 67 mils from slot 30 to a corner designated 220*a*, which lies to the left of axis 8 as illustrated in FIG. 2*b*. Side 120*c* extends from corner 220*a* to a corner designated 220*b*, which is 60 mils closer to the datum than side 120*b* and 10 mils closer to axis 8 than corner 220*a*. Thus, corner 220*b* lies 140 mils from datum 100 and 57 mils from axis 8. Side 120*d* extends from corner 220*b* to a corner 220*c*, which is 20 mils closer to datum than corner 220*b*, and 45 mils closer to axis 8. Thus, corner 220*c* is 120 mils from datum 100, and lies on axis 8. Side 120*e* of aperture 20 extends from corner 220*c* to a corner 220*d*, which lies 140 mils from datum 100 and 45 mils from axis 8, to the right of the axis as illustrated in FIG. 2*b*. Side 120*f* extends from corner 220*d* to corner 220*e*.

Figure 2C:
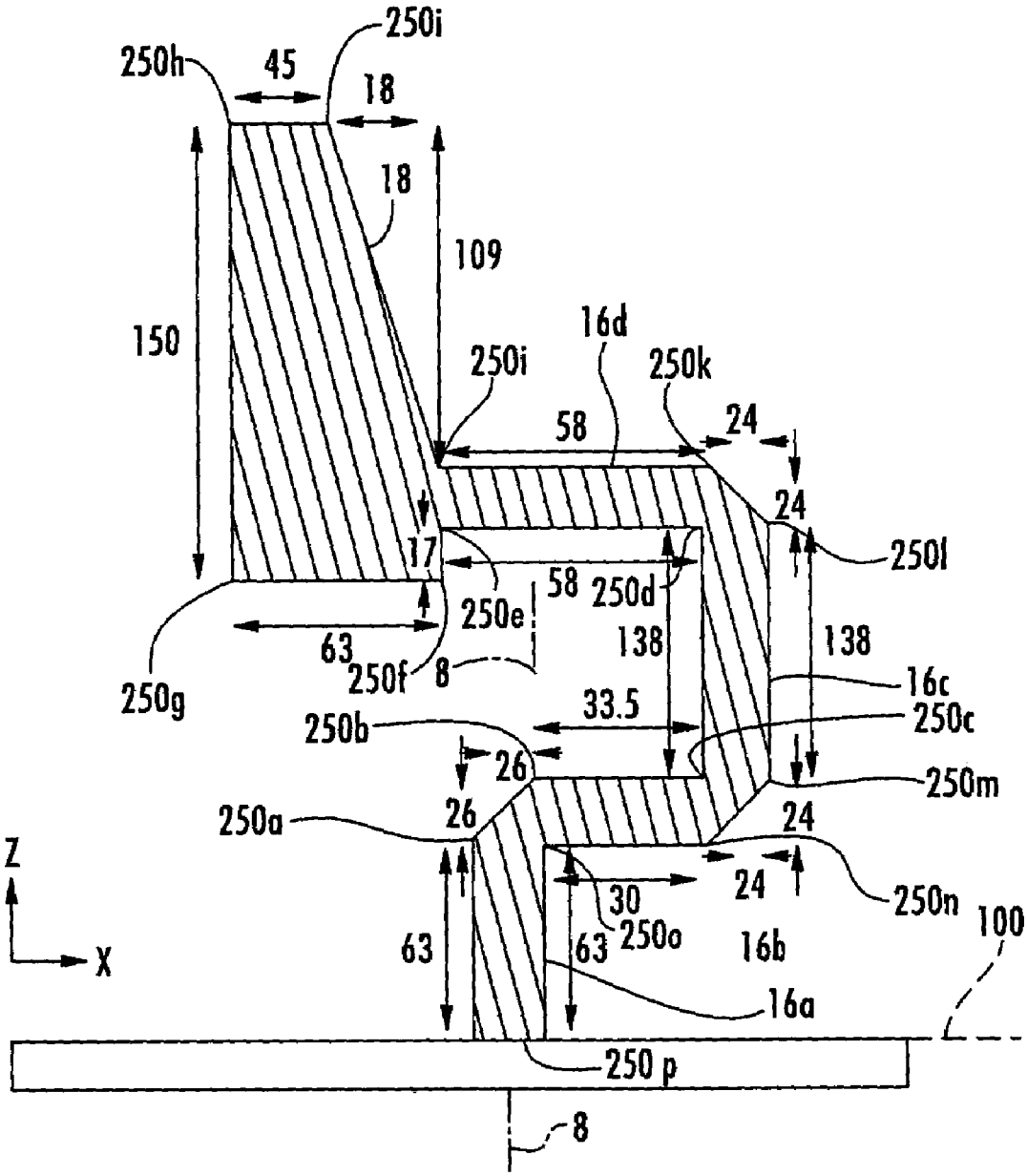

FIG. 2*c* illustrates details of the dimensions of the feed structure for the embodiment of the invention associated with FIGS. 2*a* and 2*b*. In FIG. 2*c*, that portion 16*a* of strip feed conductor 16 has a width of 26 mils where it meets datum plane 100. It should be understood that the width of the strip conductors is selected to maintain a suitable impedance match to a standard impedance, such as 50 ohms, and the width is affected by the dielectric constant of the surrounding medium. In the case of FIG. 2*c*, the dielectric material has a dielectric constant of 2.2 and the strip conductors lie at a distance of 0.0155 inch (15.5 mils) from each of conductive plates 12 and 52. Strip conductor portion 16*a* of FIG. 2*c* projects orthogonally, parallel with and centered on axis 8, from datum 100. One side of strip conductor portion 16*a* has a length of 63 mils, and meets a juncture at a corner 250*a*, which has an x position of 13.5 mils (13.5 mils to the left of axis 8 as seen in FIG. 2*c*) and a z position of 63 mils (63 mils from datum 100). A side of the juncture extends from corner 250*a* to a corner 250*b*, which has an x position of −12.5 mils and a z position of 89 mils. Consequently, corner 250*b* lies 89 mils from datum 100, and has a z position of 12.5 mils to the right of axis 8. A side of strip conductor portion 16*b* extends from corner 250*b* to a corner 250*c*, which has a location of x=−46 mils, z=89 mils. Strip conductor 16*c* has a width of 24 mils. A side of strip conductor 16*c* extends from corner 250*c* to a corner 250*d*, which is located at x=−46 mils from axis 8, z=227 mils from datum 100. Strip conductor 16*d* has a width of 24 mils. A side of strip conductor 16*d* extends from corner 250*d* to a corner 250*e*, which is located at x=12 mils, z=227 mils. Corner 250*f* lies at x=12, z=210; corner 250*g* lies at x= 75, z=210; corner 250*h* lies at x=75, z=360; and corner 250*i* lies at x=30. z=360. Corner 250*j* lies at x= 12, z=251; corner 250*k* lies at x=−46, z=251; corner 2501 lies at x=−70, z=227; corner 250*m* lies at x=−70, z=89; corner 250*n* lies at x=−44, z=63; corner 250*o* lies at x=−13.5, z=63; and corner 250*p* lies at x=−13.5, z=0.

As mentioned, corners 250*e* and 250*j* define the juncture of the end of strip conductor 16*d* with stripline stub 18.

Figure 3:
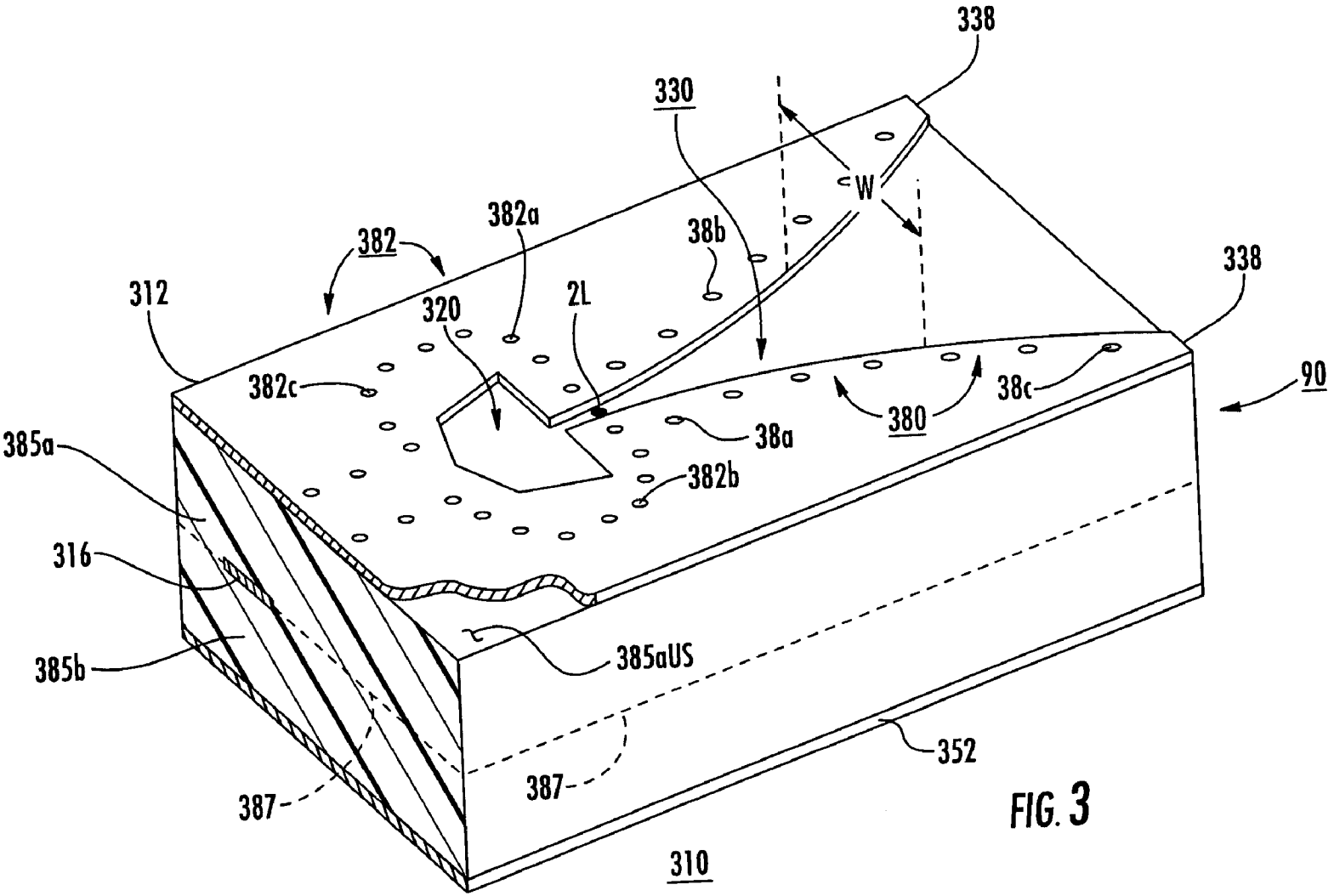
FIG. 3 is a simplified perspective or isometric view of another embodiment of the invention, in which the electrically conductive elements are supported by dielectric slabs or sheets.

FIG. 3 is a simplified illustration in perspective or isometric view, showing an antenna or radiating element generally similar to that of FIGS. 1*a* and 1*b*, but fabricated on juxtaposed sheets of dielectric material. In FIG. 3, an electrically conductive upper plate 312 defines a through aperture 320 and a slot 330 extending from an edge of the through aperture to an end 338 of the plate 312. Upper plate 312 lies on a dielectric sheet or plate 385*a*. A lower electrically conductive plate 352 defines a through aperture and a slot identical to aperture 320 and slot 330, and registered therewith. Lower plate 352 includes a through aperture and a tapered slot, registered with the corresponding elements of the upper plate, as described in more detail in relation to FIGS. 1*a*, 1*c*, 2*a*, 2*b*, and 2*c*. Lower plate 352 is affixed to a second dielectric sheet or plate 385*b*. Dielectric sheets or plates 385*a* and 385*b* are juxtaposed or joined along a juncture 387, with a feed structure 316 extending therebetween. An edge of a strip conductor of the feed structure is visible in FIG. 3. Thus, the region 90 shown in FIG. 1*b* as lying between the conductive plates can be filled with dielectric material.

Also visible in FIG. 3 as circles, some of which are designated 380*a*, 380*b*, 380*c*, are the ends of a set or plurality 380 of through conductors which provide electrical interconnection between conductive plates 312 and 352 at locations adjacent the edges of the slots. These through conductors may be in the form of plated-through vias.

In addition to the through conductors of set 380, the arrangement of FIG. 3 illustrates as circles, some of which are designated 382*a*, 382*b*, and 382*c*, a set 380 of through conductors which electrically interconnect upper plate 312 with lower plate 352 at locations near the feed structure 316 and the through aperture 320. The through conductors of sets 380 and 382 tend to maintain corresponding portions of the upper and lower conductive plates at the same potential, which aids in suppression of unwanted modes. The use of these through conductors may be viewed as making the two separated conductive plates act as though they were the upper and lower edges of a solid conducting structure, without adversely affecting the feed structure.

Figures 4A, 4B:
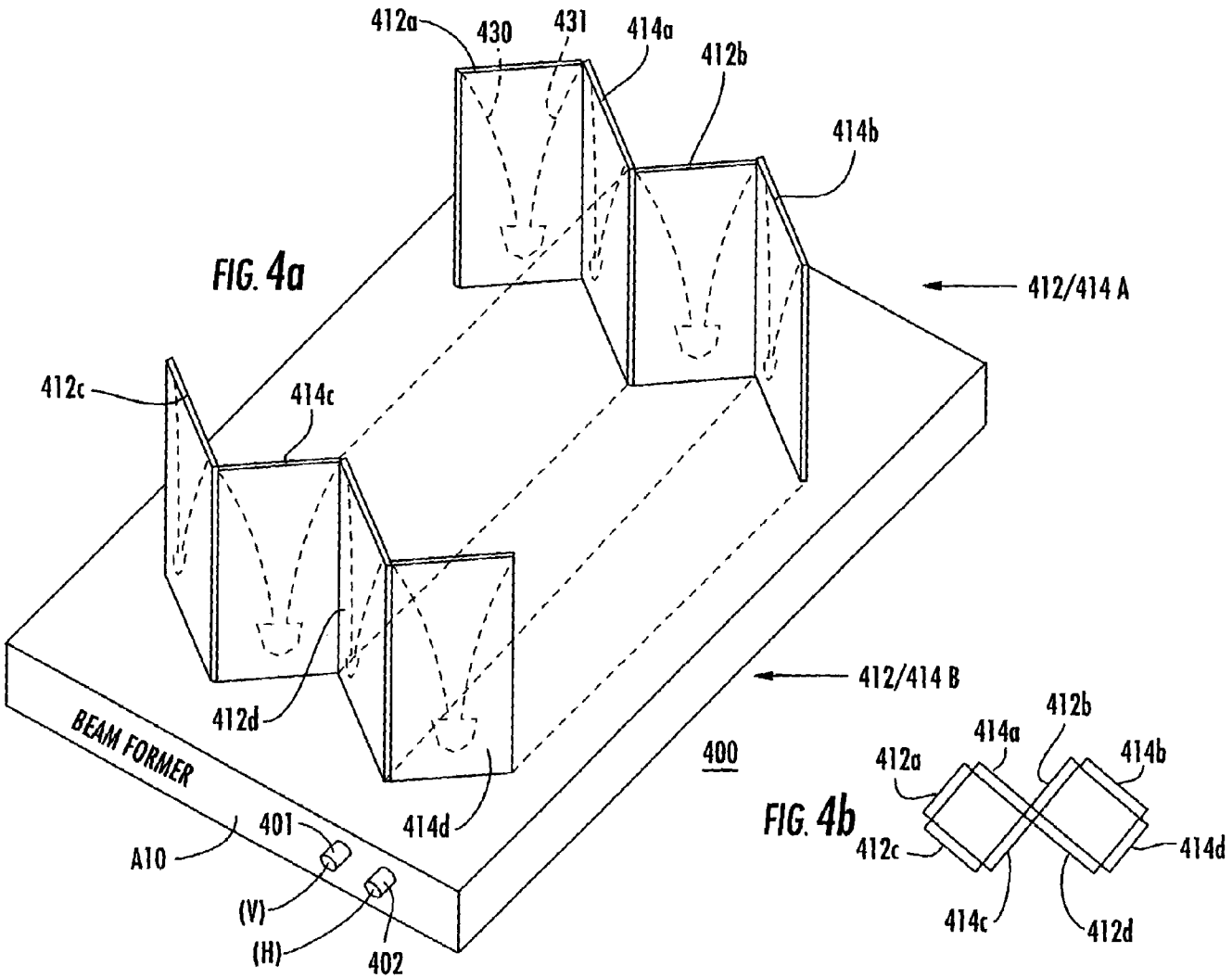
FIG. 4*a* is a simplified, exploded, perspective or isometric view of a portion of an array of antennas such as the antenna of FIGS. 1*a*, 1*b*, ic, 2*a*, 2*b*, and 2*c* and or 3 mounted adjacent a beamformer.
FIG. 4*b* is a view looking orthogonally at the surface of the beamformer.

FIG. 4*a* is a simplified, exploded perspective or isometric illustration suggesting how a plurality of antennas can be mounted in relation to a beamformer for operation as an array. Each of the antennas is illustrated as a planar structure electrically connected to, and extending above, a planar beamformer 410. A first antenna is illustrated as a planar structure 412*a*. The upward-oriented slot (larger portion of the slot on top) of antenna 412*a* is suggested in FIG. 4*a* by the tapered slot edges 430, 431. A second antenna, oriented with its plane orthogonal to the plane of antenna 412*a*, is designated 414*a*, and its slot is also upward-oriented. The mutually orthogonal orientations of the planar structures of antennas 412*a* and 414*a* results in transduction of electromagnetic signals with their electric fields in mutually orthogonal planes. These mutually orthogonal fields are often termed Vertical (V) and Horizontal (H) for convenience, regardless of their actual orientation relative to the vertical. They may also be referred to as "E" plane and "H" plane. Thus, antenna 412*a* could transduce a "V" field, and antenna 414*a* would then transduce an "H" field. The field orientation is often used to describe the antenna itself. Thus, antenna 412*a* might be termed a "V" antenna, and 414*a* an "H" antenna. The line array 412/414A including antennas 412*a* and 414*a* as illustrated in FIG. 4*a* also includes a further V antenna 412*b* and a further H antenna 414*b*. All the antenna elements of the array 400 of FIG. 4*a* have their slots facing upward. The array 400 of FIG. 4*a* is a surface or area array (as opposed to a line array), in that there are multiple line arrays 412/414A, 412/414B. Eight antennas are illustrated. Set of antennas 412/414A includes antennas 412*a*, 414*a*, 412*b*, 414*b*, and the second set of antennas 412/414B of the array 400 includes antennas 412*c*, 414*c*, 412*d*, 414*d*. Set 412/414B of antennas is illustrated separated from set 412/414A for ease of illustration and to make their relative orientations clear. In an actual embodiment using these two antenna sets, the sets are mutually adjacent, forming a physical pattern in which each antenna forms a side of a square or parallelepiped. Thus, when the arrays 412/414A and 412/414B are juxtaposed, the planes of antennas 412*b*, 414*b*, 412*d*, and 414*d* touch along their edges to define an "egg-crate" pattern which, viewed in a direction orthogonal to the plane of the beamformer 410 as in FIG. 4*b*, has the appearance of a square. Beamformer 410 makes connection to the V antennas of the array separately from the connection of the H antennas, and separate V and H common ports 401, 402 are provided on the beamformer.

Figure 5A:
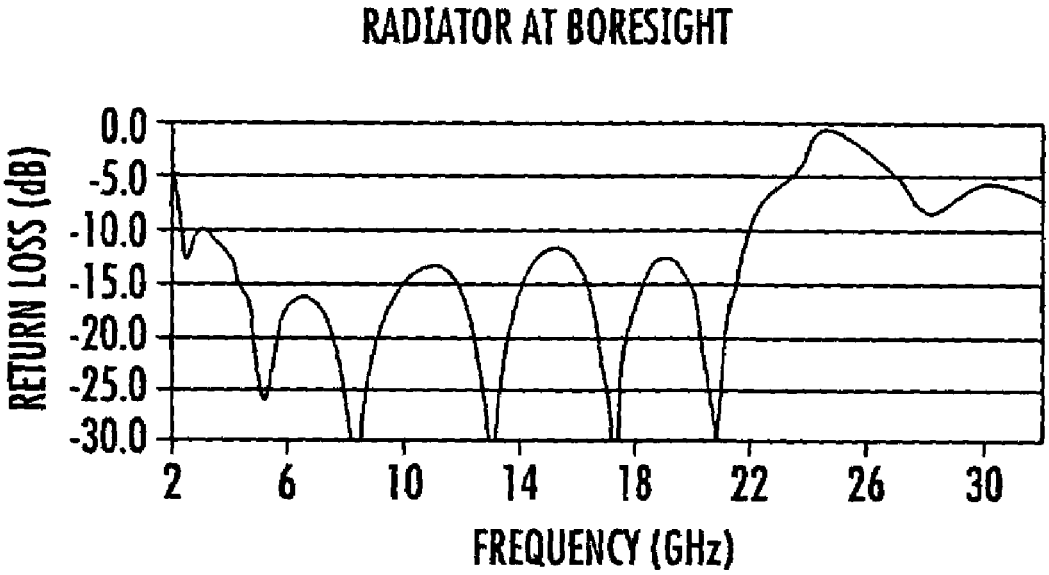
FIGS. 5*a* and 5*b* are plots of return and scan loss, respectively, calculated for an array of antennas similar to that suggested in FIGS. 4*a* and 4*b* interconnected with an ideal 50-ohm beamformer at boresight and at a 60° scan angle, respectively.
Figure 5B:
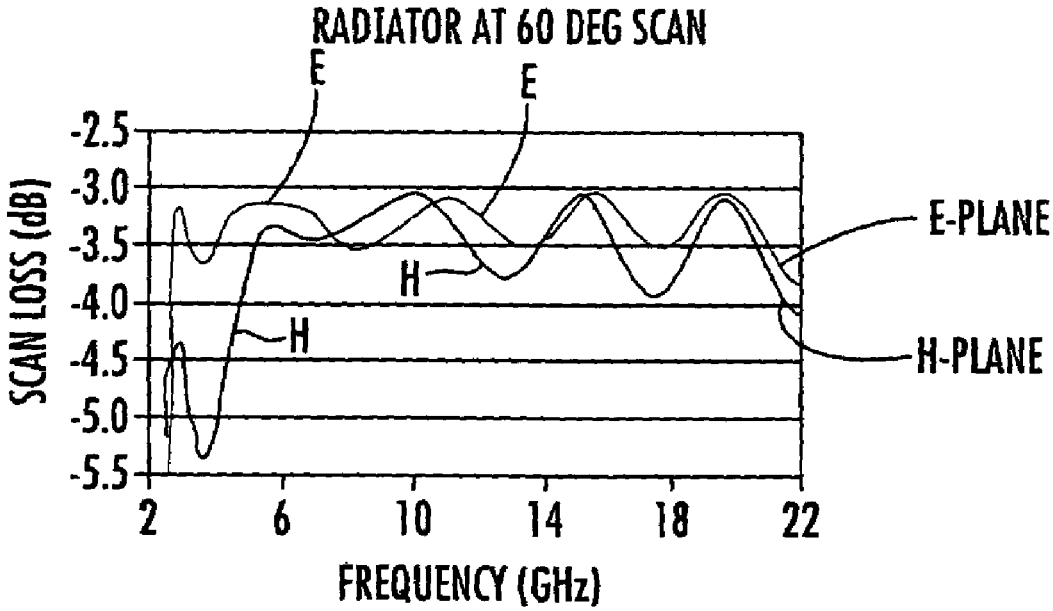

FIG. 5*a* is a calculated plot of return loss of an element when all elements in the array are excited for an array such as that of FIGS. 4*a* and 4*b*, with the beamformer set for broadside radiation, at either the E-plane (Vertical) or H-plane (Horizontal) input port of the beamformer. As can be seen, the return loss is below about 10 dB in the frequency range from about 2.5 GHz to about 22 GHz. FIG. 5*b* illustrates plots of the scan loss over the frequency range of about 2 to 22 GHz for the V (E-plane) and H (H-plane) ports, with the beamformer set for 60° of scan. The scan loss is the reduction of beam-peak energy resulting from scanning, attributable to reductions in the off-boresight directivity of the elemental antennas of the array, mutual coupling factors, and possibly other factors. As illustrated in FIG. 5*b*, the beam-peak scan loss at 60° scan angle ranges around 3 to 4 dB over the frequency range of about 2.5 to 22 GHz.

A radiating element (10) according to an aspect of the invention comprises an electrically conductive first plate (12) defining a through aperture (20) and also defining a slot (30) extending from the aperture (20) to an edge (38) of the plate (12). The slot (30) has a transverse dimension (W) in the plane of the first plate (12). The transverse dimension (W) increases monotonically with increasing distance between the aperture (20) and the edge (38) of the first plate (12). The radiating element also comprises an electrically conductive second plate (52) defining a second through aperture (60) identical to the through aperture (20) of the first plate (12). The second plate (52) also defines a second slot (70) extending from the second through aperture (60) to an edge (78) of the second plate (52). The second slot (70) has transverse dimensions in the plane of the second plate (52) which are identical to those of the transverse dimension (W) of the slot (30) of the first plate (12). The first (12) and second (52) plates are spaced apart (S), with the through aperture (60) and the slot (70) of the second plate (52) registered with the through aperture (20) and the slot (30) of the first plate (12). A feed element (16, 18) including a strip conductive element (16) lies midway between the plane of the first plate (12) and the plane of the second plate (52). The feed element (16, 18) extends across the slots (30, 70) at a location (L) removed from the through apertures (20, 60) and from the edges (38, 78) of the first (12) and second (52) plates.

In a particularly advantageous embodiment of the radiator of the invention, the region (90) between the first (12) and second (52) plates includes solid dielectric material (385*a*, 385*b*). The shape or dimensions of the slots (30, 70) may be exponentially increasing with increasing distance from the apertures (20, 60). In one embodiment, the slot (30, 70) transverse dimensions (W) are piecewise-linear or a plurality of straight-line segments.

In one advantageous version of this aspect of the invention, the radiating element (10) comprises a set or plurality (80) of electrically conductive elements (80*c*, 80*d*) extending between, and connecting to, the first (12) and second (52) plates at least at locations adjacent the slots (30, 70). In one version, a set or plurality (82) of electrically conductive elements (82*a*, 82*b*, 82*c*) extends between the first (12) and second (52) plates at locations adjacent the feed element (16, 18).

A radiating element (310) according to another aspect of the invention comprises first (312) and second (352) dielectric sheets, each defining a first broad surface (385*aus*) and a second broad surface. The radiating element (310) also includes an electrically conductive first plate (312) defining a through aperture (320), and also defining a slot (330) extending from the aperture (320) to an edge of the first plate (320). The slot (330) has a transverse dimension (W) in the plane of the first plate (312) which increases monotonically with increasing distance from the aperture (320). The electrically conductive first plate (312) is affixed to the first broad surface (385*aus*) of the first dielectric sheet (385*a*). The radiator (310) also includes an electrically conductive second plate (352) defining a second through aperture identical to the through aperture of the first plate, and also defining a second slot extending from the second through aperture to an edge of the second plate. The second slot has transverse dimensions in the plane of the second plate which are identical to those of the slot of the first plate. The second plate (352) is affixed to the first broad side of the second dielectric sheet (385*b*). The second sides of the first and second dielectric sheets are juxtaposed at a juncture (387), with the first (312) and second (352) plates being spaced apart by the thickness of the first (385*a*) and second (385*b*) dielectric sheets, and with the through aperture and the slot of the second plate (385*b*) registered with the through aperture (320) and the slot (330) of the first plate (385*a*). A feed element (316) including a strip conductive element lies in the juncture (387), with the feed element (316) extending across the slots at a location removed from the through apertures and from the edges (338) of the first (312) and second (352) plates. In a particular embodiment of this aspect of the invention, the radiating element (310) further comprises a plurality (380) of electrical conductors extending between, and making electrical connection with, the first (312) and second (352) plates, at locations lying adjacent the slots (330) in the first (312) and second (352) plates.

An antenna array (400) according to another aspect of the invention comprises a plurality of elemental radiating elements (412*a*, 412*b*, 412*c*, 412*d*, 414*a*, 414*b*, 414*c*, 414*d*). Each of the radiating elements (412*a*, 412*b*, 412*c*, 412*d*, 414*a*, 414*b*, 414*c*, 414*d*) includes (a) An electrically conductive first plate (12) defining a through aperture (20), and also defining a slot (30) extending from the aperture (20) to an edge (38) of the plate (12). The slot (30) has a transverse dimension(s) (W) in the plane of the first plate (12), which dimension (s) increases monotonically with increasing distance from the aperture (20).

(b) An electrically conductive second plate (52) defining a second through aperture (60) identical to the through aperture (20) of the first plate (12), and also defining a second slot (70) extending from the second through aperture (60) to an edge (78) of the second plate (52). The second slot (70) has transverse dimensions in the plane of the second plate (52) which are identical to those of the slot (30) of the first plate (12). The first (12) and second (52) plates are spaced apart (S), with the through aperture (60) and the slot (70) of the second plate (52) registered with the through aperture (20) and the slot (30) of the first plate (12).

(c) A feed element (16) including a strip conductive element lying midway between the plane of the first plate (12) and the plane of the second plate. The feed element (16) extends across the slots (20, 60) at a location removed from the through apertures (20, 60) and from the edges (38, 78) of the first (12) and second (52) plates.

The plurality of radiating elements (412*a*, 412*b*, 412*c*, 412*d*, 414*a*, 414*b*, 414*c*, 414*d*) is arrayed with the edges (38, 78) of the plates lying in a plane, and with the planes of the plates (12, 52) of at least some of the radiating elements (412*a*, 412*b*, 412*c*, 412*d*) lying in planes orthogonal to the planes of the plates (12, 52) of the remaining ones (412*a*, 412*b*, 412*c*, 412*d*, 414*a*, 414*b*, 414*c*, 414*d*) of the radiating elements (412*a*, 412*b*, 412*c*, 412*d*, 414*a*, 414*b*, 414*c*, 414*d*). The beamformer (410) is electrically connected to the feed elements (16) of the radiating elements (412*a*, 412*b*, 412*c*, 412*d*, 414*a*, 414*b*, 414*c*, 414*d*). In one embodiment, the beamformer (410) electrically connects together those radiating elements (412*a*, 412*b*, 412*c*, 412*d*) which have their plates (12, 52) mutually parallel to a first plane independently of those radiating elements (414*a*, 414*b*, 414*c*, 414*d*) which have their plates (12, 52) lying in a second plane mutually orthogonal to said first plane.

What is claimed is:

1. A radiating element, comprising:

an electrically conductive first plate defining a through aperture and also defining a slot extending from said aperture to an edge of said plate, said slot having a transverse dimension in the plane of said first plate which dimension increases monotonically with increasing distance between said aperture and said edge of said first plate;

an electrically conductive second plate defining a second through aperture identical to said through aperture of said first plate, and also defining a second slot extending from said second through aperture to an edge of said second plate, said second slot having transverse dimensions in the plane of said second plate which are identical to those of said transverse dimensions of said slot of said first plate, said first and second plates being spaced apart with said through aperture and said slot of said second plate being registered with said through aperture and said slot of said first plate;

a feed element including a strip conductive element lying midway between said plane of said first plate and said plane of said second plate, said feed element extending across said slots at a location removed from said through apertures and from said edges of said first and second plates.

2. A radiating element according to claim 1, wherein the region between said first and second plates includes solid dielectric material.

3. A radiating element according to claim 1, wherein said transverse dimensions of said slot are in the form of a plurality of straight-line segments.

4. A radiating element according to claim 1, further comprising a plurality of electrically conductive elements extending between, and connecting to, said first and second plates at least at locations adjacent said slot.

5. A radiating element according to claim 4, further comprising a plurality of electrically conductive elements extending between said first and second plates at locations adjacent said feed element.

6. A radiating element according to claim 1, wherein said feed element terminates at a location, and further including an enlarged portion adjacent the termination.

7. A radiating element, comprising:

a first dielectric sheet defining a first broad surface and a second broad surface; including an electrically conductive first plate defining a through aperture and also defining a slot extending from said aperture to an edge of said plate, said slot having a transverse dimension in the plane of said first plate which dimension increases monotonically with increasing distance from said aperture, said electrically conductive first plate being affixed to said first broad surface of said first dielectric sheet;

a second dielectric sheet defining first and second broad surfaces;

an electrically conductive second plate defining a second through aperture identical to said through aperture of said first plate, and also defining a second slot extending from said second through aperture to an edge of said second plate, said second slot having transverse dimensions in the plane of said second plate which are identical to those of said transverse dimensions of said slot of said first plate, said second plate being affixed to said first broad side of said second dielectric sheet, said second sides of said first and second dielectric sheets being juxtaposed at a juncture, with said first and second plates being spaced apart by said first and second dielectric sheets, and with said through aperture and said slot of said second plate being registered with said through aperture and said slot of said first plate; and a feed element including a strip conductive element lying in said juncture, said feed element extending across said slots at a location removed from said through apertures and from said edges of said first and second plates.

8. A radiating element according to claim 7, further comprising a plurality of electrical conductors extending between, and making electrical connection with said first and second plates, at locations lying adjacent said slots in said first and second plates.

9. A radiating element according to claim 8, wherein said electrical conductors include electrically conductive plated-through vias.

10. An antenna array, said antenna array comprising:

a plurality of elemental radiating elements, each of said radiating elements including an electrically conductive first plate defining a through aperture and also defining a slot extending from said aperture to an edge of said plate, said slot having a transverse dimension in the plane of said first plate which dimension increases monotonically with increasing distance from said aperture;

an electrically conductive second plate defining a second through aperture identical to said through aperture of said first plate, and also defining a second slot extending from said second through aperture to an edge of said second plate, said second slot having transverse dimensions in the plane of said second plate which are identical to those of said transverse dimensions of said slot of said first plate, said first and second plates being spaced apart with said through aperture and said slot of said second plate being registered with said through aperture and said slot of said first plate; and a feed element including a strip conductive element lying midway between said plane of said first plate and said plane of said second plate, said feed element extending across said slots at a location removed from said through apertures and from said edges of said first and second plates;

said plurality of radiating elements being arrayed with said edges of said plates lying in a plane, and with the planes of said plates of at least some of said radiating elements lying in planes orthogonal to the planes of said plates of the remaining ones of said radiating elements.

11. An antenna array according to claim 10, further comprising a beamformer electrically coupled to said feed element of each of said elemental antenna elements.

12. An antenna array according to claim 11, wherein said beamformer couples together said feed elements of those of said radiating elements which have the planes of their plates parallel with a first plane independently of said feed elements of those of said radiating elements which have the planes of their plates parallel with a second plane, orthogonal to said first plane.

13. An antenna, comprising:

first and second electrically conductive, separated, mutually parallel and registered plates, each of said plates comprising a tapered slot defining edges, said slot having widths of 6, 10, 16, 22, 32, 44, 60, 80, 100, 120, and 140 mils at distances of 200, 350, 450, 550, 650, 750, 850, 950, 1050, 1150, and 1250 mils, respectively, from a datum line; and an aperture coupled to said slot at a location adjacent that portion of said slot having a width of 6 mils.

14. An antenna according to claim 13, wherein said slots are centered about axes, and further comprising an electrically conductive feed structure lying midway between said first and second plates, said feed structure having edges located at xy coordinates, where said x coordinates are relative to one of said axes and said y coordinates are relative to said datum line, and said edges include

| X | Y |
|---|---|
| 13.5 mils | 63 mils |
| −12.5 | 89 |
| −46 | 89 |
| −46 | 227 |
| 12 | |
| 227 | |
| 12 | 251 |
| −46 | 251 |
| −70 | 227 |
| −70 | 89 |
| −44 | 63 |
| −13.5 | 63 |
| −13.5 | 0. |

15. An antenna according to claim 14, further comprising a further feed structure conductive region connected at x=12, y=227 and at x=12, y=251, and having edges at

| X | Y |
|---|---|
| 12 mils | 227 mils |
| 75 | 210 |
| 75 | 360 |
| 30 | 360. |

* * * * *

UNITED STATES PATENT AND TRADEMARK OFFICE

CERTIFICATE OF CORRECTION

PATENT NO. : 6,967,624 B1
APPLICATION NO. : 10/830797
DATED : November 22, 2005
INVENTOR(S) : Chih-Chien Hsu and Mirwais Zeweri It is certified that error appears in the above-identified patent and that said Letters Patent is hereby corrected as shown below:

Column 1, line 7, replace contract number "SOMA N00014-02-C-0479" with -- N00014-02-C-0474 --.

Signed and Sealed this

Thirteenth Day of May, 2008

JON W. DUDAS
*Director of the United States Patent and Trademark Office*